US007040890B2

(12) United States Patent
Todoli et al.

(10) Patent No.: US 7,040,890 B2
(45) Date of Patent: May 9, 2006

(54) GAS BURNER

(75) Inventors: Silvano Todoli, Forli Cesena (IT); Stefano Strada, Forli Cesena (IT); Marco Starnini, Forli Cesena (IT)

(73) Assignee: Electrolux Home Products Corp. N.V., Zaventem (BE)

( * ) Notice: Subject to any disclaimer, the term of this patent is extended or adjusted under 35 U.S.C. 154(b) by 49 days.

(21) Appl. No.: 10/932,146

(22) Filed: Sep. 2, 2004

(65) Prior Publication Data

US 2005/0112520 A1 May 26, 2005

(30) Foreign Application Priority Data

Sep. 5, 2003 (EP) ..... 03020118

(51) Int. Cl.
*F23Q 3/00* (2006.01)

(52) U.S. Cl. ..... 431/266; 431/349; 239/545

(58) Field of Classification Search ..... 431/266, 431/344, 349, 354, 345; 239/545; 126/39 E
See application file for complete search history.

(56) References Cited

U.S. PATENT DOCUMENTS 2,965,165 A * 12/1960 Arnott et al. ..... 239/432
5,915,956 A * 6/1999 Kwiatek et al. ..... 431/349

* cited by examiner

*Primary Examiner*—S. Gravini
(74) *Attorney, Agent, or Firm*—Wenderoth, Lind & Ponack, L.L.P.

(57) ABSTRACT

A gas burner, for example, for domestic cooking appliances, includes a bowl-shaped body associated with a gas injector, a toothed crown with a plurality of flame ports placed over the body, and an upper cap to close the burner top. The burner also has a peripheral grove that is formed on at least a part of the external surface of the toothed crown in order to increase the flame stability.

10 Claims, 2 Drawing Sheets

GAS BURNER

BACKGROUND OF THE INVENTION

1. Field of the Invention

The present invention relates to a new gas burner, in particular, for use in a domestic cooker, which is provided with an improved burner crown.

2. Description of the Related Art

A gas burner is substantially formed by a bowl-shaped body, a toothed crown and an upper cap. The bowl-shaped body is associated with an injector through which the gas is supplied. The burner crown is provided on its circumference with a plurality of ports to let a gas-air mixture exit in a radial direction. The cap closes the burner top and defines the flame ports together with the burner crown.

This kind of gas burner has flame ports equidistant from each other and of two or more different sizes. Moreover, the flame ports could also be different in length and width in order to let the gas-air mixture leave the burner at a desired velocity, pressure, inclination and at a requested distribution along the burner circumference. Some burner ports also have the function of a pilot flame, and they guarantee flame stability when flow variations, for instance, due to changes of rate (maximum to minimum and vice-versa), and external air turbulence could disturb the flame.

The flame stability under different operative conditions is a serious problem for all kinds of gas burners.

A main drawback is the flame breakdown from the burner cap, which occurs both in longitudinal and circular directions during the normal functioning of the burner. At present, a technical solution to reduce this danger is represented by a cap whose diameter is larger than that of the burner crown and, in particular, larger than the diameter of the flame port circumference.

This solution is not satisfactory from a technical point of view. In fact, the flame stability is also a function of the burning velocity of the gas-air mixture. By increasing the quantity of air in the mixture, the quality of the combustion is improved, but the burning velocity also increases; consequently, the flame stability decreases and approaches the flame lift limit. An enlarged diameter of the burner cap does not remove this drawback.

In addition, a cap larger than the burner crown is not a better solution from an aesthetic point of view.

SUMMARY OF THE INVENTION

The main scope of the present invention is to provide a gas burner with a modified crown, which overcomes the above drawbacks, such that its functional and aesthetic characteristics are improved without the need to use special and costly technology.

These and other advantages are obtained with a burner according to the present invention.

BRIEF DESCRIPTION OF TH DRAWINGS

The invention will be better appreciated from the following description given solely by way of non-limiting example and with reference to the accompanying drawings, wherein.

DETAILED DESCRIPTION OF THE INVENTION

Figure 1:
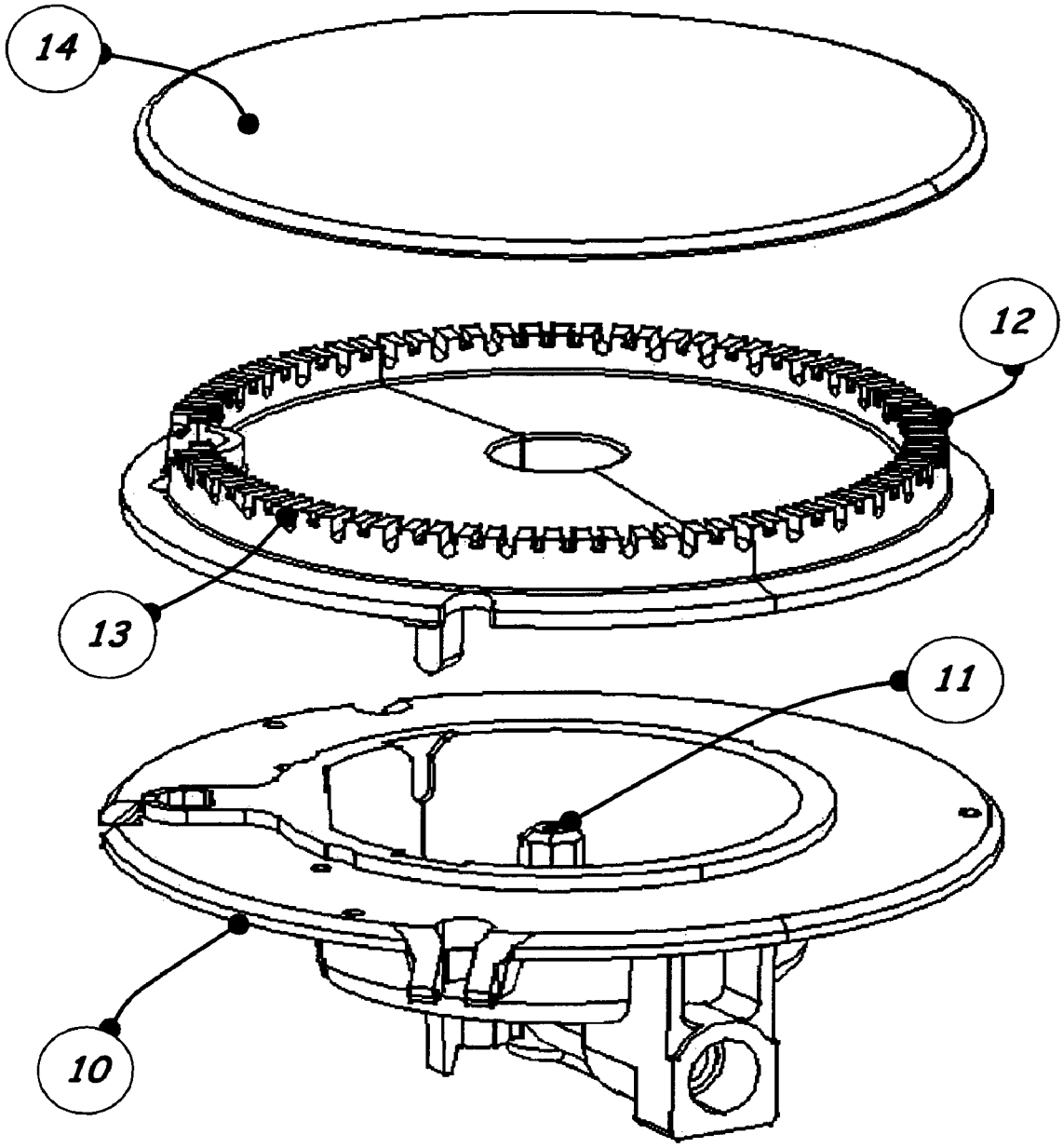
FIG. 1 is an exploded view of a gas burner according to the present invention.

With reference to FIG. 1, a gas burner comprises: a bowl-shaped body 10, which is associated with a gas injector (e.g., a mini-vertical Venturi tube) 11 to let the gas enter in the burner; a toothed crown 12, which leans on the bowl-shaped body 10 and is provided with a plurality of flame ports 13 circumferentially arranged along the periphery of the crown 12; and an upper cap 14, which closes the burner top.

Normally, the flame ports 13 are obtained by alternating high and low teeth along the periphery of the crown 12.

Figure 2:
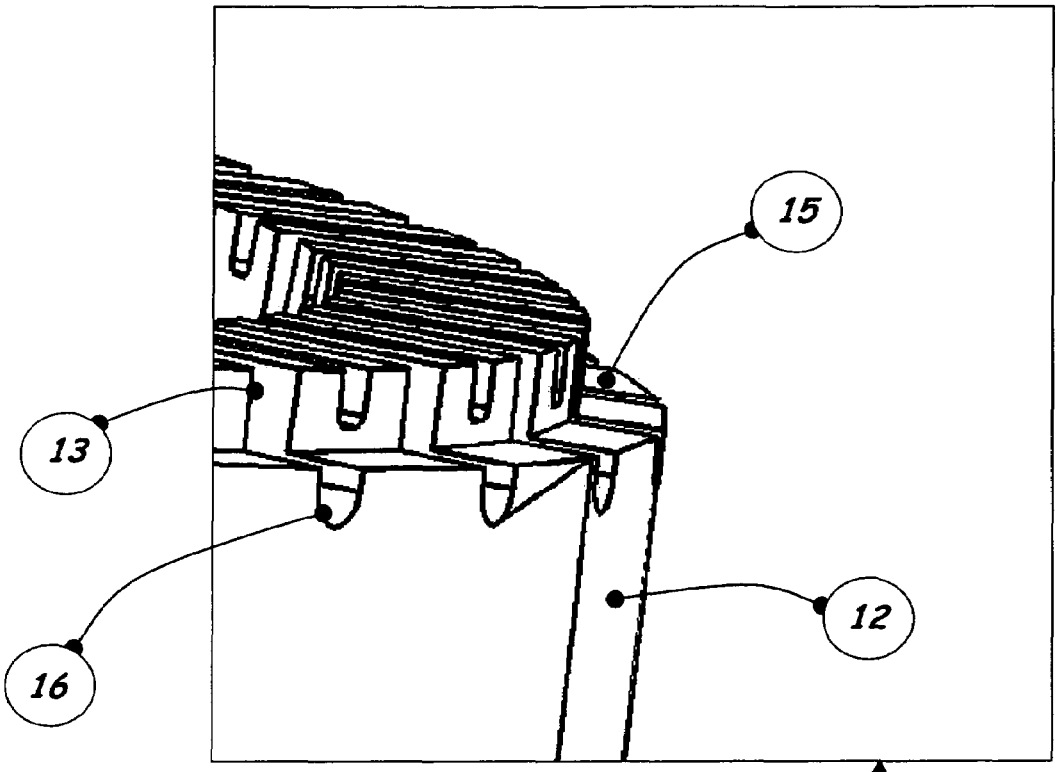
FIG. 2 is an enlarged perspective view of a part of a gas burner according to the present invention.
Figure 3:
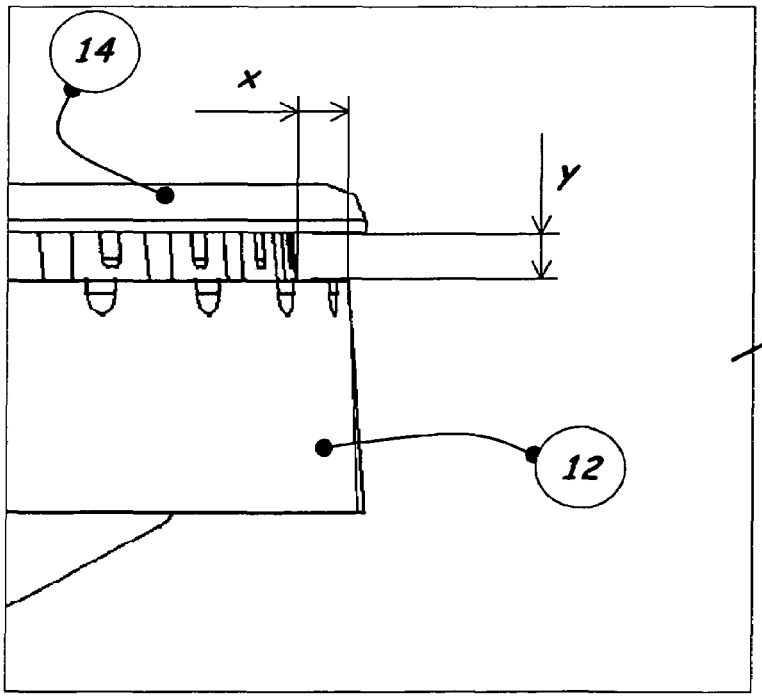
FIG. 3 is an elevation side view of the gas burner of FIG. 2.

According to the present invention (FIGS. 2 and 3), a peripheral step 15 is formed on at least a part of the external surface of the toothed crown 12. The peripheral step 15 is preferably provided at a level lower than that of the flame ports 13 and its upper surface is smooth. Alternatively, at least part of the peripheral step 15 is crossed by a number of radial grooves 16, which are connected with corresponding flame ports 13 of the toothed crown 12.

The shape and size of the peripheral step 15, in particular the ratio between width "x" and height "y" (FIG. 3), may be chosen depending on the kind of gas to be used and on different functional parameters of the burner itself.

The peripheral step 15 gives to the burner ports an innovative double section shape, with the inner one (firstly met by the gas) having a reduced section compared with the outer one. This feature creates a kind of "double conduit" which ensures a reduction for the flame velocity on the external periphery of the toothed crown 12, so as to improve the flame stability and avoiding the danger of a flame detachment.

The peripheral step 15 also allows a better distribution of the flame to be obtained around the toothed crown 12, and a faster cross-lighting of the gas-air mixture leaving the burner. The advantages are achieved due to the continuity of the flame anchorage to the crown 12, which is ensured by the step 15.

Lastly, by adopting the disclosed solution of the peripheral step 15, it is possible to employ an upper cap 14 having substantially the same diameter of the toothed crown 12, without any danger of flame detachment. This feature further improves the functionality and aesthetics of the burner. Indeed, besides all the mentioned advantages, the burner according to the invention allows a reduction of volume of the flame under pan support grids, so as to avoid the cooling of the flame which increases the CO production.

The invention claimed is:

1. A gas burner comprising:

a bowl-shaped body;

a gas injector associated with said bowl-shaped body;

a toothed crown having a raised portion with a plurality of flame ports formed therein and an outer peripheral portion extending outward from at least a part of an outer periphery of said raised portion at a level lower than that of said flame ports so as to form a peripheral step; and an upper cap closing a top of the gas burner, wherein said toothed crown is located over said bowl-shaped body.

2. A gas burner according to claim 1, wherein said outer peripheral portion has a smooth surface.

3. A gas burner according to claim 2, wherein said upper cap has substantially a same diameter as said outer peripheral portion of said toothed crown.

4. A gas burner according to claim 1, wherein said outer peripheral portion is at least partially crossed by a plurality of radial grooves connected with corresponding flame ports of said toothed crown.

5. A gas burner according to claim 4, wherein said upper cap has substantially a same diameter as said outer peripheral portion of said toothed crown.

6. A gas burner according to claim 1, wherein said upper cap has substantially a same diameter as said outer peripheral portion of said toothed crown.

7. A gas burner according to claim 1, wherein said gas injection is a mini-vertical Venturi tube.

8. A gas burner according to claim 7, wherein said upper cap has substantially a same diameter as said outer peripheral portion of said toothed crown.

9. A gas burner according to claim 7, wherein said outer peripheral portion has a smooth surface.

10. A gas burner according to claim 7, wherein said outer peripheral portion is at least partially crossed by a plurality of radial grooves connected with corresponding flame ports of said toothed crown.

* * * * *